US011933589B2

(12) United States Patent
Bergmann

(10) Patent No.: US 11,933,589 B2
(45) Date of Patent: Mar. 19, 2024

(54) BOOSTER CHARGE HOLDER FOR AN INITIATOR SYSTEM

(71) Applicant: DynaEnergetics Europe GmbH, Troisdorf (DE)

(72) Inventor: Joerg Bergmann, Eitorf (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 382 days.

(21) Appl. No.: 17/413,036

(22) PCT Filed: Dec. 17, 2019

(86) PCT No.: PCT/EP2019/085528
§ 371 (c)(1),
(2) Date: Jun. 11, 2021

(87) PCT Pub. No.: WO2020/148052
PCT Pub. Date: Jul. 23, 2020

(65) Prior Publication Data

US 2022/0018638 A1 Jan. 20, 2022

Related U.S. Application Data

(60) Provisional application No. 62/792,460, filed on Jan. 15, 2019.

(51) Int. Cl.
*F42B 3/26* (2006.01)
*E21B 43/00* (2006.01)
(Continued)

(52) U.S. Cl.
CPC ..... *F42B 3/26* (2013.01); *E21B 43/00* (2013.01); *E21B 43/117* (2013.01);
(Continued)

(58) Field of Classification Search
CPC .. F42B 3/26; F42C 19/09; F42D 1/043; E21B 3/00; E21B 3/117; E21B 3/119; E21B 43/00; E21B 43/117; E21B 43/119
See application file for complete search history.

(56) References Cited

U.S. PATENT DOCUMENTS 2,679,380 A 5/1954 Sweetman
2,754,760 A 7/1956 Wynn
(Continued)

FOREIGN PATENT DOCUMENTS

AU 615570 B2 10/1991
AU 199954954 A1 4/2000
(Continued)

OTHER PUBLICATIONS

Australian Government, Examination report No. 1 for standard patent application, dated Jun. 28, 2019, 7 pgs.
(Continued)

*Primary Examiner* — Bret Hayes
(74) *Attorney, Agent, or Firm* — Womble Bond Dickinson (US) LLP

(57) ABSTRACT

According to some embodiments, a holding device for a detonation initiation system is disclosed. The holding device includes an initiator holder having a longitudinal internal cavity. The longitudinal internal cavity is configured to retain an initiator and an electrical cable in electrical contact with the initiator. The holding device further includes a plurality of retention fingers configured for retaining a shaped charge adjacent the initiator. The plurality of retention fingers define a shaped charge receiving portion that may be configured to receive shaped charges of different shapes. The holder may be formed from a thermoplastic material.

17 Claims, 5 Drawing Sheets

(51) Int. Cl.

| | |
|---|---|
| ***E21B 43/117*** | (2006.01) |
| ***E21B 43/119*** | (2006.01) |
| ***F42C 19/09*** | (2006.01) |
| ***F42D 1/04*** | (2006.01) |

(52) U.S. Cl.
CPC ..... *E21B 43/119* (2013.01); *F42C 19/09* (2013.01); *F42D 1/043* (2013.01)

(56) References Cited

U.S. PATENT DOCUMENTS

| | | | | |
|---|---|---|---|---|
| 3,092,025 | A | 6/1963 | Hradel et al. | |
| 4,753,301 | A | 6/1988 | Berry | |
| 4,771,827 | A * | 9/1988 | Barker | E21B 23/04 166/377 |
| 4,938,143 | A * | 7/1990 | Thomas | F42B 3/10 102/318 |
| 4,987,818 | A | 1/1991 | Alford | |
| 5,123,356 | A | 6/1992 | Brooks et al. | |
| 5,129,322 | A | 7/1992 | Christopher et al. | |
| 5,705,768 | A | 1/1998 | Ey | |
| 6,006,671 | A * | 12/1999 | Yunan | F42D 1/04 102/275.9 |
| 6,460,462 | B1 | 10/2002 | Rosenstock | |
| 6,684,791 | B1 | 2/2004 | Barnhart | |
| 7,054,131 | B1 | 5/2006 | Kanth et al. | |
| 7,107,908 | B2 | 9/2006 | Forman et al. | |
| 7,228,906 | B2 | 6/2007 | Snider et al. | |
| 7,565,930 | B2 | 7/2009 | Seekford | |
| 7,610,969 | B2 | 11/2009 | LaGrange et al. | |
| 7,992,495 | B2 | 8/2011 | Rowe et al. | |
| 8,302,523 | B2 | 11/2012 | Bell | |
| 8,789,467 | B2 | 7/2014 | Crawford | |
| 9,169,695 | B1 | 10/2015 | Calvert | |
| 9,243,879 | B2 | 1/2016 | Thomson et al. | |
| 2005/0011390 | A1 | 1/2005 | Jennings | |
| 2005/0034624 | A1 | 2/2005 | Forman et al. | |
| 2005/0173118 | A1 | 8/2005 | Li et al. | |
| 2005/0188871 | A1 | 9/2005 | Forman et al. | |
| 2007/0084336 | A1 * | 4/2007 | Neves | E21B 43/119 102/305 |
| 2007/0193467 | A1 | 8/2007 | Bengtsson | |
| 2008/0282925 | A1 | 11/2008 | Lownds et al. | |
| 2010/0092136 | A1 | 4/2010 | Nhep | |
| 2012/0192748 | A1 * | 8/2012 | Scheid | F42B 3/26 403/221 |
| 2013/0145924 | A1 * | 6/2013 | Zhang | E21B 43/119 89/1.15 |

FOREIGN PATENT DOCUMENTS

| | | | | |
|---|---|---|---|---|
| AU | 200028890 | A1 | 10/2000 | |
| AU | 2008250971 | A1 | 11/2008 | |
| CA | 2393565 | A1 | 9/2000 | |
| CA | 2306536 | C | 7/2006 | |
| CA | 2685484 | C | 2/2016 | |
| CN | 202707014 | U * | 1/2013 | |
| EP | 1644693 | B1 | 12/2006 | |
| GB | 108977 | A | 8/1917 | |
| GB | 168820 | A | 9/1921 | |
| WO | 2005005919 | A1 | 1/2005 | |
| WO | 2008138070 | A1 | 11/2008 | |
| WO | 2010093997 | A1 | 8/2010 | |
| WO | WO-2013110982 | A2 * | 8/2013 | E21B 23/01 |
| WO | 2016110395 | A1 | 7/2016 | |
| WO | 2020016644 | A1 | 1/2020 | |

OTHER PUBLICATIONS

Australian Government, Examination report No. 2 for standard patent application, dated Mar. 25, 2020, 3 pgs.

Flashpoint—Visual Collectors, WWII British Militaria for sale, Dec. 15, 2017, 19 pgs., https://www.visualcollector.com/Tommy/TommyStuff/TommyStuff.htm.

Ideal Industrial Explosives Ltd., Emulsion Explosives, Jul. 27, 2013, 3 pgs., http://www.idealexplosives.com/emulsion-explosives.html.

International Searching Authority, International Search Report and Written Opinion of PCT Application No. PCT/EP2019/085528, dated Mar. 5, 2020, 13 pgs.

LEXPEV.NL, Grenades, mines and boobytraps, EMU-1 Jan. 20, 2012, 5 pgs., https://www.lexpev.nl/fuzesandigniters/yugoslavia/emu1.html.

Lone Sentry, Haft-Hohlladung 3 Kg.: Magnetic Hollow Charge Antitank Mine « Catalog of Enemy Ordnance, published on Jan. 2, 2010, 3 pgs.

Lone Sentry, Schuss Gr. P-40: H.E.A.T. (Hollow Charge) Grenade, Jan. 3, 2010, 4 pgs.http://www.lonesentry.com/ordnance/schuss-gr-p-40-hollow-char.

Wikimedia Commons, File: Panzerfaust 2.jpg, Jan. 2018, 3 pgs., https://commons.wikimedia.org/wiki/File: Panzerfaust_2.jpg.

WW2 Equipment Data, British Explosive Ordnance Army and Navy Demolition Stores, Apr. 17, 2017, 8 pgs., http://ww2data.blogspot.com/2017/04/british-explosive-ordnance-army-and.html.

International Searching Authority; International Preliminary Report on Patentability of the International Searching Authority for PCT/EP2021/066119; dated Jul. 29, 2021; 9 pages.

* cited by examiner

BOOSTER CHARGE HOLDER FOR AN INITIATOR SYSTEM

CROSS-REFERENCE TO RELATED APPLICATIONS

This application is a national stage application of and claims priority to Patent Cooperation Treaty (PCT) Application No. PCT/EP2019/085528 filed Dec. 17, 2019, which claims the benefit of U.S. Provisional Patent Application No. 62/792,460 filed Jan. 15, 2019, the entire contents of which are incorporated herein by reference in its entirety.

BACKGROUND OF THE DISCLOSURE

Oil and gas exploration and mining operations often involve the detonation of explosives within an underground formation, for example within a borehole drilled into the formation. Oftentimes, explosives are disposed at the desired point in the borehole and detonated by an initiating charge, e.g., a shaped charge that is itself detonated by an initiator, lowered into the borehole after placement of the main explosives.

The initiator is typically carried by a wireline or similar structure extending from the surface down into the borehole. It is crucial that the placement, speed, and direction of the wireline is accurate, not just for the safety of nearby equipment but also for the safety of personnel involved. A typical initiator and initiator holder used to detonate a main explosive or another explosive downhole tool need to be simple, inexpensive, robust and easy to use. In the event that an initiator and initiator holder may include significant structures other than the initiating charge itself, it is highly advantageous that the initiating charge be provided separately from the remainder of the apparatus and inserted into the apparatus as close in time to insertion of the initiator into the borehole as possible. Under such circumstances, the non-explosive portion of the initiator is sometimes referred to as the initiator holder or the like. Assembly of the electronically activated initiator portion of the initiator into the initiator holder needs, also, to be simple, robust and serve to minimize errors/failures.

Assembly of the electronically activated initiator portion and the initiator holder also typically involves attachment of the electronically activated initiator portion to an electrical cable that conveys an electrical signal or voltage to the electronically activated initiator, resulting in initiation of the electronically activated initiator portion thereof. The electrical cable may be an element of the wireline extending to the surface of the borehole or may simply be the wireline itself. Maintaining a connection between the electrical cable and the initiator is one extremely important function of the initiator holder.

There is a need for a device that can support and connect the initiator, electrical cable and shaped charge during the mining process. This device needs to be simple, inexpensive, robust, easy to use, easy to assemble and minimize errors/failures.

BRIEF DESCRIPTION OF THE EXEMPLARY EMBODIMENTS

According to an aspect, a holding device is disclosed for use in a detonation system. The holding device may include an initiator holder having a first end, a second end, and a longitudinal internal cavity formed within the initiator holder and extending from the first end to the second end.

The internal cavity may be configured for retaining an initiator and an electrical cable. The holding device may also include a plurality of retention fingers extending from the first end of the initiator holder configured for retaining a shaped charge within the holding device.

The internal cavity of the holding device may include a first section having a diameter configured for retaining the electrical cable. The internal cavity may further include a second section having a diameter configured for retaining the initiator. The diameter of the second section may be greater than the diameter of the first section of the internal cavity. The holding device may further include a plurality of longitudinal sections. In one case, the holding device may include a first longitudinal half-section and a second longitudinal half-section. The first half-section may be identical to the second half-section. The first half-section may include tabs and the second half section may include corresponding slots formed for mateable engagement with the tabs of the first half-section.

The initiator holder may include an external surface and the holding device may include a top clip positioned on the external surface of the initiator holder and configured for urging the first half-section and the second half-section radially inward. An internal wall of the internal cavity adjacent the top clip may frictionally retain the electrical cable and thereby prevent any tension from pulling against the sealing plug of the initiator. The top clip may include a protruding lip configured to latch onto the external surface of the initiator holder. The initiator holder may include an external surface and the holding device may include a bottom clip positioned on the external surface adjacent the first end of the initiator holder. The bottom clip may be connected by frictional engagement or by mated engagement with the initiator holder.

The holding device may further include at least four retention fingers. The shaped charge may be aligned longitudinally with the initiator. The electrical cable may be connected to the initiator and configured to convey an electrical activation signal to the initiator. The initiator may be wireless and pressure-sealed. The retention fingers may be shaped for retaining a conical shaped charge or a slotted shaped charge. The shaped charge may be an encapsulated and hydraulically sealed shaped charge. Each of the retention fingers may be spaced apart from each other, thus allowing direct contact between an explosive emulsion in a borehole and the shaped charge. The retention fingers may further include a plurality of receiving grooves on an interior surface of each of the retention fingers. The grooves may be configured to engage one or a plurality of mated grooves on an exterior surface of the shaped charge. The holding device may further include a plurality of apertures within the initiator holder configured to provide passage for borehole fluids. The plurality of apertures may be formed longitudinally within the exterior surface of the initiator holder or as circular channels in the initiator holder. The holding device may be injection molded and may be composed of a thermoplastic material. The thermoplastic material may comprise at least one of polyamide, polypropylene, polyethylene, polymethylene oxide, polytetrafluoroethylene, perfluoro(ethylene-propylene), nylon, polyethylene terephthalate, polyvinylidene fluoride and combinations thereof.

According to an aspect, the present embodiment may be associated with a holding device for a detonation system. The holding device may include an initiator holder configured to receive an initiator. The holding device may further include a shaped charge holder configured to receive a shaped charge. The shaped charge holder can extend from the initiator holder and be aligned with the initiator holder such that the initiator is vertically/longitudinally aligned with a back-wall portion of the shaped charge. Further, the shaped charge holder may include a plurality of fingers configured to retain the shaped charge therebetween.

The holding device may also comprise a first section and a second section of the initiator holder. The first section of the initiator may be configured for retaining the initiator, and the second section of the initiator holder may be configured for retaining an electrical cable. The electrical cable may be configured for providing a firing signal to the initiator. The holding device may further comprise at least one clip slideably positioned on an external surface of the initiator holder. The at least one clip may be configured for securing a first half-section of the initiator holder to a second half-section of the initiator holder.

In one aspect, the holding device may comprise a first clip and a second clip. The first clip may be positioned at the second end of the initiator holder, and the second clip may be positioned at the first end of the initiator holder. Further, the initiator holder may also comprise an internal cavity for receiving the initiator and the electrical cable. The internal cavity may comprise a contoured surface that may frictionally engage the electrical cable.

The initiator holder and the shaped charge holder, as explained above, may be injection molded. The holding device may be configured for use with an explosive emulsion in a borehole. The detonation system holding device can be used in detonating an explosive emulsion in a borehole. By using such detonation system holding device, explosive capacity in a borehole operation can be improved.

BRIEF DESCRIPTION OF THE DRAWINGS

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Figure 1:
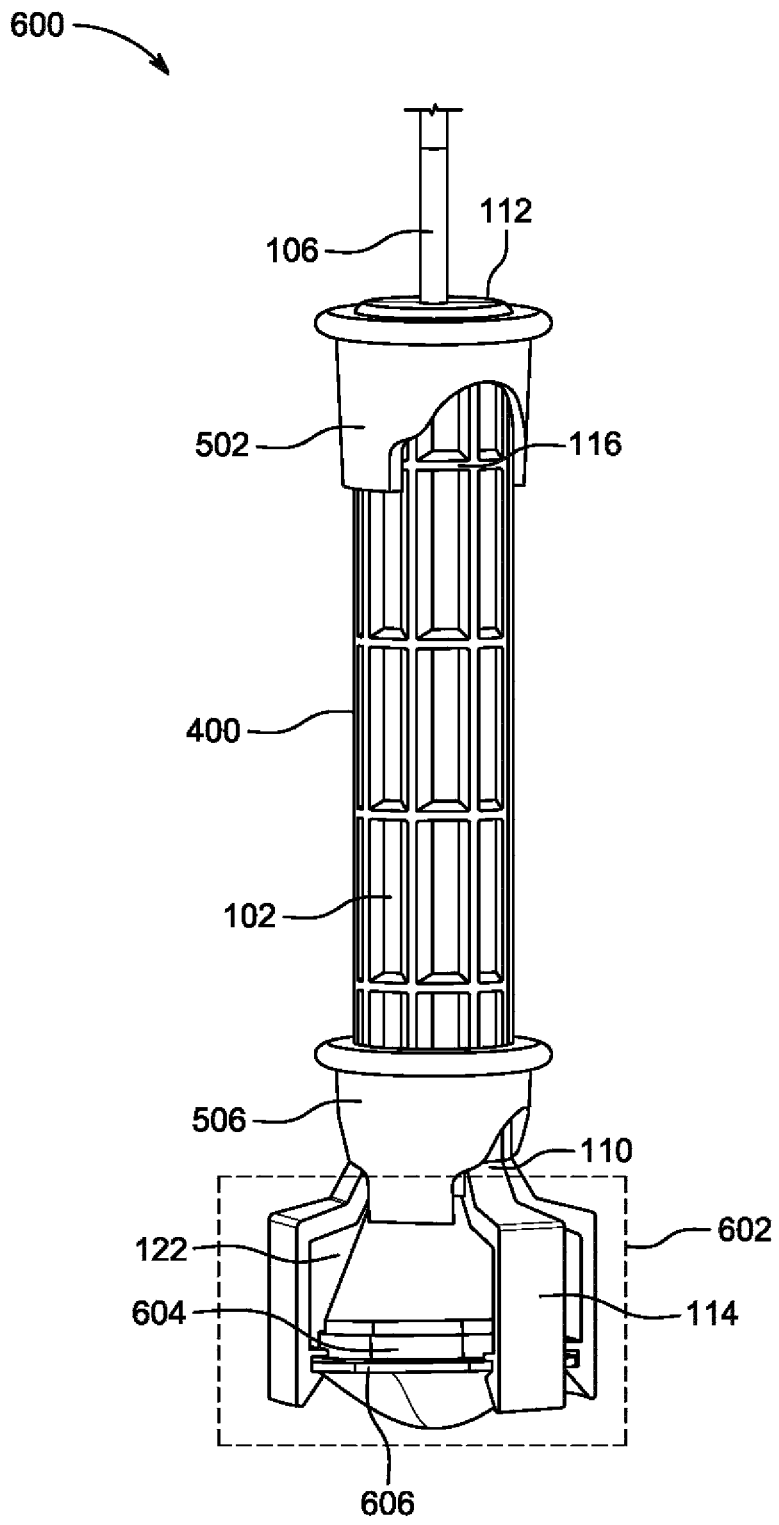
FIG. 1 is a perspective view of the holding device, according to an embodiment.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to some embodiments.

The headings used herein are for organizational purposes only and are not meant to limit the scope of the description or the claims. To facilitate understanding, reference numerals have been used, where possible, to designate like elements common to the figures.

DETAILED DESCRIPTION

Reference will now be made in detail to various embodiments. Each example is provided by way of explanation and is not meant as a limitation and does not constitute a definition of all possible embodiments.

In the description that follows, the terms "holder", "cavity", "clip", "fingers", "grooves", "apertures" and/or "channels", and other like terms are to be interpreted and defined generically to mean any and all of such elements without limitation of industry usage. Such terms used with respect to embodiments in the drawings should not be understood to necessarily connote a particular orientation of components during use.

For purposes of illustrating features of the embodiments, several embodiments will now be introduced and referenced throughout the disclosure. Those skilled in the art will recognize that these embodiments are illustrative, not limiting and are provided purely for explanatory purposes. In such embodiments, as illustrated using FIG. 1, a fully assembled holding device 600 for housing an initiator 104 (see FIG. 2) and a shaped charge 604 for mining applications is disclosed. The initiator 104 and the shaped charge 604 function as an initiator/booster to detonate explosive emulsion/gel that is pre-filled in a borehole/mining shaft. The holding device 600 is lowered into a borehole containing explosive emulsion/gel to perforate the borehole wall. The initiator 104 is activated by an electronic signal conveyed by electrical cable 106, and the shaped charge 604 is initiated in turn by initiator 104, causing detonation of the explosive emulsion/gel.

Figure 2A:
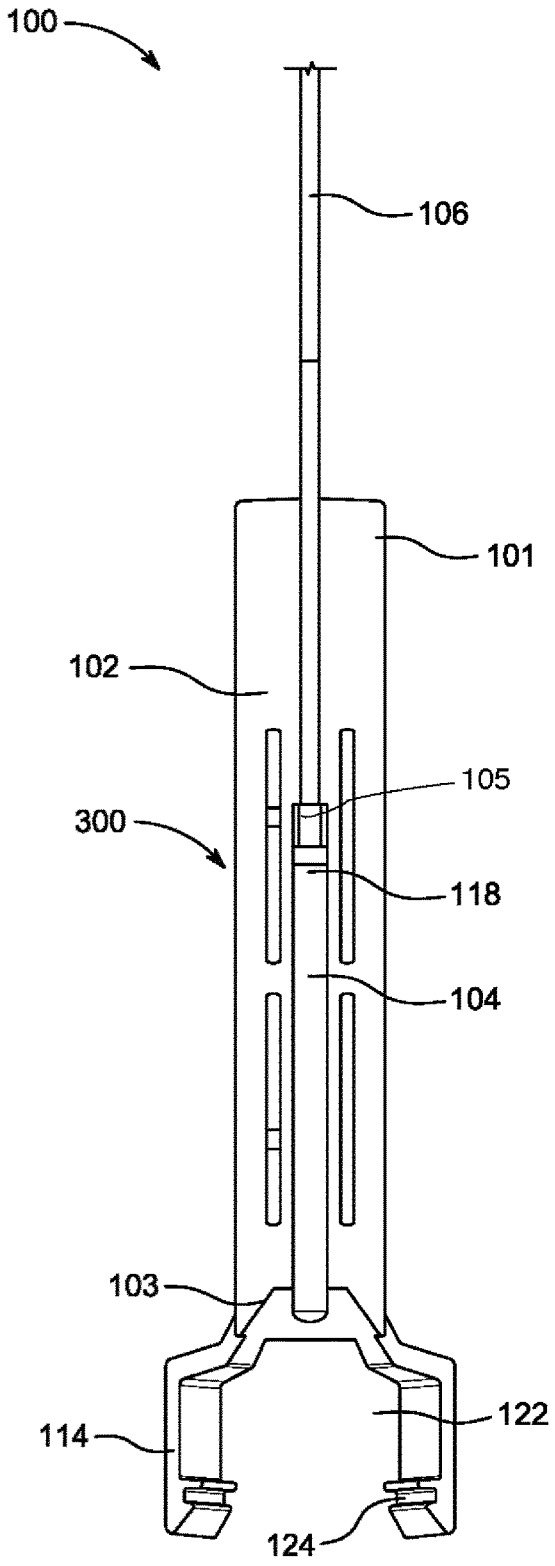
FIG. 2A is a plan view of one half of a holding device and associated structures.
Figure 2B:
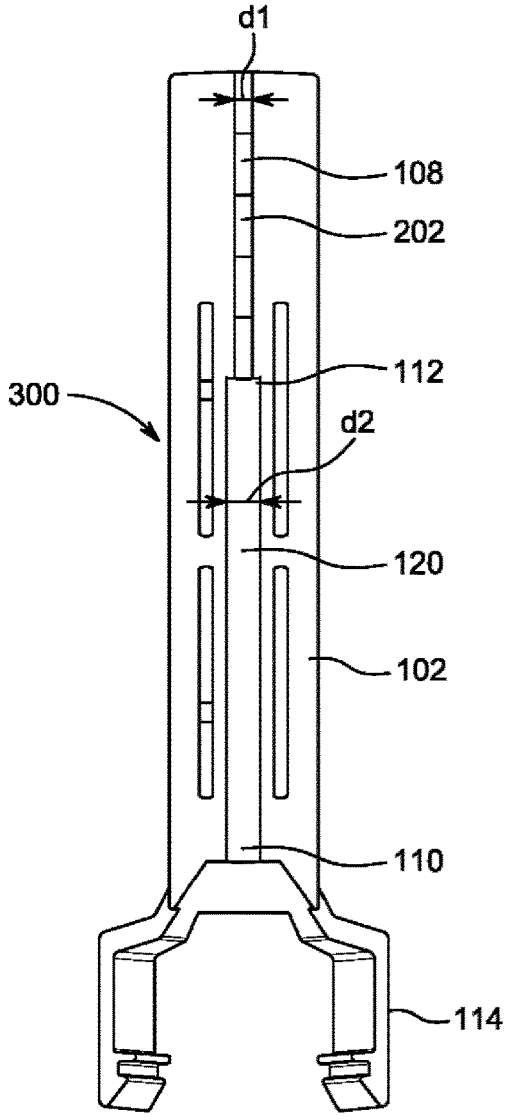
FIG. 2B is a plan view of the half of holding device mateable with the half shown in FIG. 2A.

With reference to FIGS. 2A and 2B, the exemplary holding device 100 includes an initiator receiving section 120, an electrical cable receiving portion 202 and a shaped charge receiving portion 122. The initiator receiving section 120 is cylindrical in shape, has a first end 110, a second end 112 and is sized to receive the initiator 104. In an embodiment, the holding device 100 being divided approximately in half results in the initiator receiving section 120 being divided in two half cylinders. The initiator 104 is positioned in the initiator receiving section 120 with an electrical cable 106 extending outward from the proximal end 118 of the initiator 104. The electrical cable 106 attaches to the proximal end 118 of the initiator 104 in the area where it resides in the holder, i.e., adjacent the second end 112 of the initiator receiving section 120.

Figure 3:
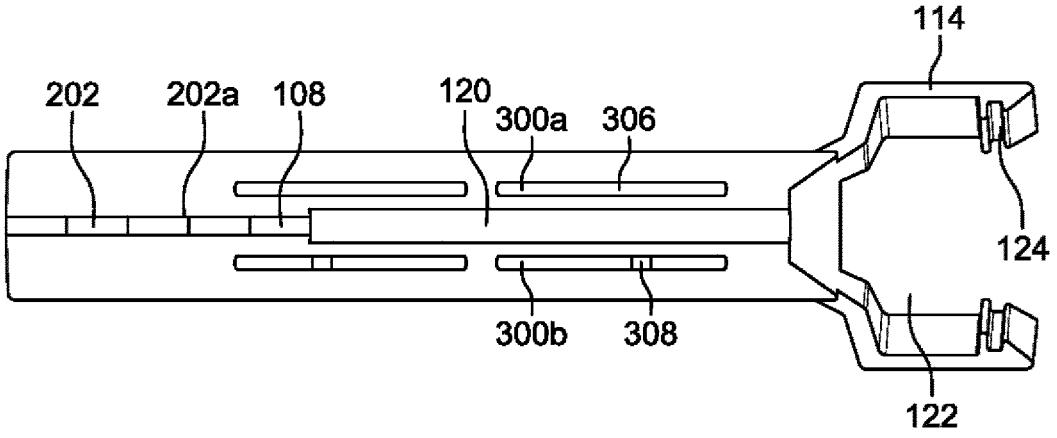
FIG. 3 is a plan view of one half of the holding device.

The point at which electrical cable 106 connects to the initiator 104 is one of the more delicate components of systems of this type and, therefore, this connection is prone to failure. The electrical cable receiving portion 202 shown in FIGS. 2B and 3 is designed to overcome the issues of delicacy in the connection of cable 106 and initiator 104. The electrical cable receiving portion 202 extends completely through the proximal end 101 of the initiator holder 102. The electrical cable receiving portion 202 has a diameter equal to or, perhaps, slightly less than the diameter of the electrical cable 106 such that the electrical cable 106 is frictionally engaged by the walls of the electrical cable receiving portion 202. Additionally, internal ribs or protrusions 202*a* may extend from the walls of the electrical cable receiving portion 202 to further augment the frictional engagement provided by the walls of the electrical cable receiving portion 202. Whether with or without protrusions 202*a*, frictional engagement and retention of the electrical cable 106 by the walls of the electrical cable receiving portion 202 greatly reduces the likelihood of forces pulling the electrical cable 106 out of connection with the initiator 104, which is a common problem in existing electrical cable-to-initiator connections. That is, the otherwise delicate connection between electrical cable 106 and initiator 104 is compensated for by frictional engagement of a portion of electrical cable 106 by electrical cable receiving portion 202.

The diameter d1 of the electrical cable receiving portion 202 and the diameter d2 of the initiator receiving section 120 may be modified to accommodate electrical cables and initiators of different sizes. The diameter d1 of the electrical cable receiving portion 202 may be between about 2 mm and about 8 mm. The diameter d2 of the initiator receiving section 120 may be between about 5 mm and 10 mm.

With continuing reference to FIGS. 2A-2B, the shaped charge receiving portion 122 is adjacent the first end 110 of the initiator receiving section 120 and comprises a plurality of support fingers 114 formed at the distal end 103 of the initiator holder 102. The support fingers 114 are arranged about a central axis of the initiator holder 102, may be symmetrical in shape and are spaced apart from each other. The spacing between the support fingers 114 allows them to have some resilience, such that the support fingers 114 bend slightly when inserting the shaped charge 604 and bend back to engage a portion of the shaped charge 604, retaining it in place in the shaped charge receiving portion 122. Each support finger 114 also has an engagement lug 124, shaped to engage the shaped charge 604 and secure it in place. The engagement structure 606 on shaped charge 604 may take the form of a groove, a rib, or any similar structure complementary to the engagement lug 124. The holding device 100 engages the shaped charge 604 via the engagement structure 606 such that the shaped charge 604 faces the explosive emulsion/gel disposed in the borehole. The shaped charge receiving portion 122 may be configured to receive a shaped charge 604 of varying shape, including conical, linear, and rectangular shaped charges.

FIGS. 2A and 2B each illustrate one mateable half 300 of the holding device 100 for a detonation system. In an embodiment, the mateable half 300 of FIG. 2A is identical to the mateable half 300 of FIG. 2B. It is contemplated, however, that differences may exist between the two halves of the holding device 100. The holding device 100 comprises an initiator holder 102 for retaining an initiator 104 and an electrical cable 106 within a longitudinal internal cavity 108. The longitudinal internal cavity 108 includes an initiator receiving section 120 having a first end 110 and a second end 112, and the electrical cable receiving portion 202. A plurality of retention fingers 114 may extend from a distal end of the initiator holder 102. The plurality of retention fingers 114 may be configured to retain a shaped charge 604, illustrated in FIG. 1, within the holding device 100.

Figure 4:
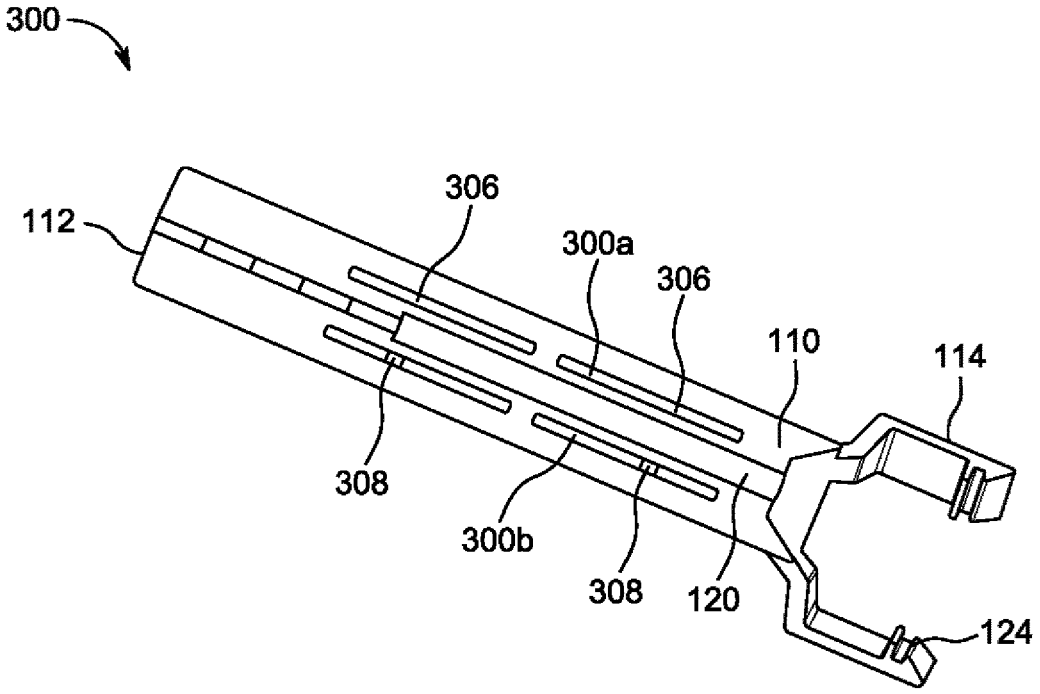
FIG. 4 is a plan view of the interior facing surface of one half of the holding device.

FIG. 4 shows a perspective view of one mateable half 300 of the two mateable halves of the holding device 100. The holding device 100 may comprise two or more such mateable longitudinal sections, amongst which one mateable half 300 of a two-piece embodiment has been illustrated and explained for simplicity. The mateable half 300 may comprise a first longitudinal engagement structure 300*a* and a second longitudinal engagement structure 300*b*. The first longitudinal engagement structure 300*a* engages the second longitudinal engagement structure 300*b*. Since each mateable half 300 has one first engagement structure 300*a* and one second engagement structure 300*b*, the two mateable halves 300 engage each other along each such structure. A number of options exist for the precise form of the first engagement structure 300*a* and the second engagement structure 300*b*. In the exemplary embodiment, the first engagement structure 300*a* has slots 306 sized to receive and retain tabs, such as tabs 308 of the second engagement structure 300*b*, on a second longitudinal section, and vice versa.

Figure 5:
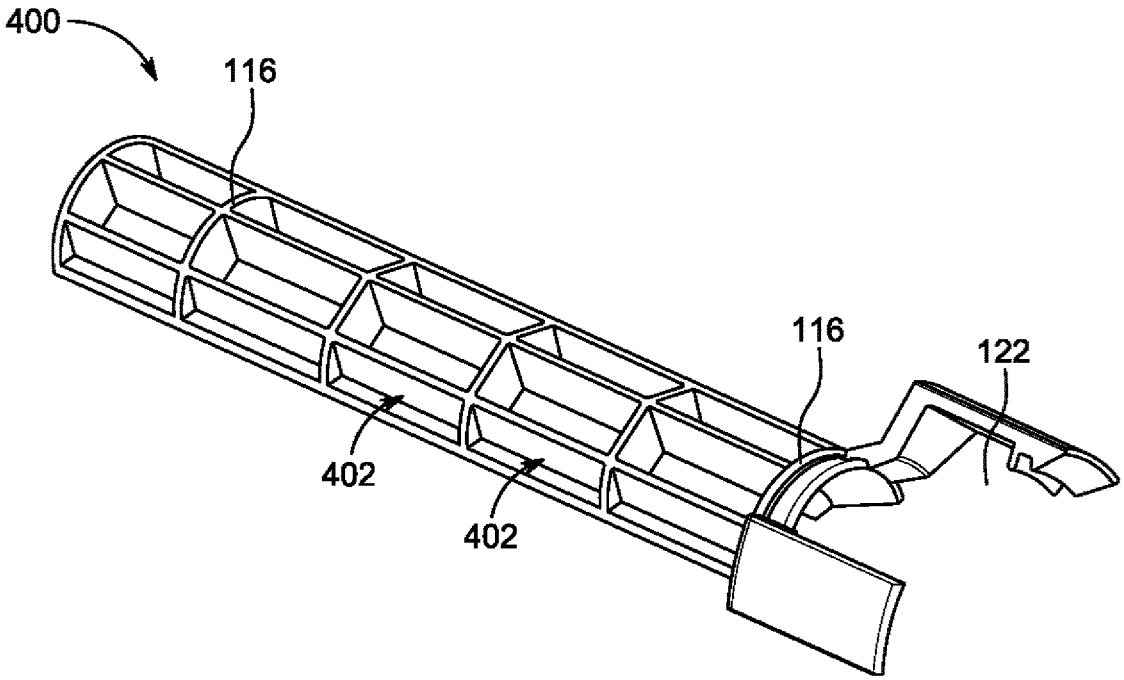
FIG. 5 is a perspective sectional view of the external facing surface of one half of the holding device.

FIG. 5 shows a perspective sectional view of an external surface 400 of the first longitudinal mateable half 300 of the initiator holder 102. The external surface 400 of the initiator holder 102 may have a plurality of apertures 402 that extend from the external surface 400 axially into the initiator holder 102. In one case, the plurality of apertures 402 may be formed longitudinally within the external surface 400 of the initiator holder 102. Further, the plurality of apertures 402 may be formed as circular channels in the initiator holder 102, or may take any shape or configuration consistent with this disclosure. The plurality of apertures 402 may extend into the initiator receiving section 120 and the electrical cable receiving portion 202, thus allowing passage of borehole fluids. Alternatively, the apertures 402 may have closed bottoms, i.e., dead-end, preventing such passage.

In an embodiment, holding device 100 may have no apertures 402 in the external surface of the initiator holder 102 or the apertures 402 may have closed bottoms. In either case, the initiator holder 102 will seal any components contained in the longitudinal internal cavity 108 from exposure to any fluids in the borehole. Since the longitudinal internal cavity 108 includes the initiator receiving section 120 and the electrical cable receiving portion 202, any structural elements contained therein will be sealed from exposure to borehole fluids.

Figure 6A:
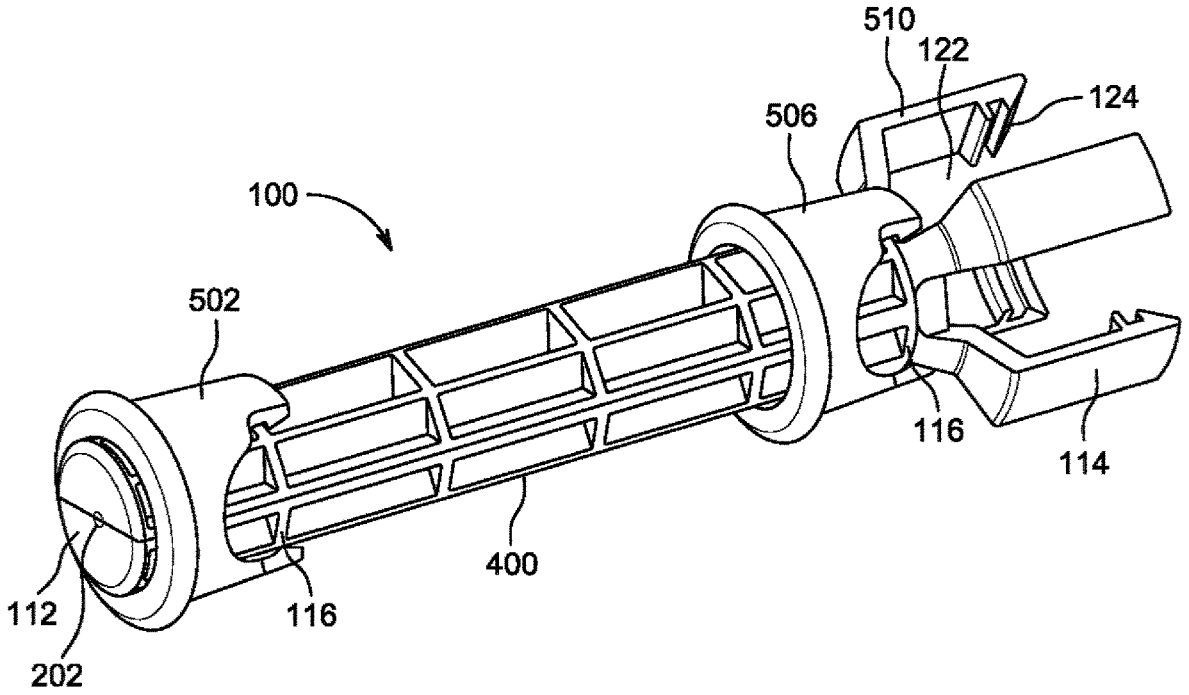
FIG. 6A is a perspective view of the holding device assembled with clips.
Figure 6B:
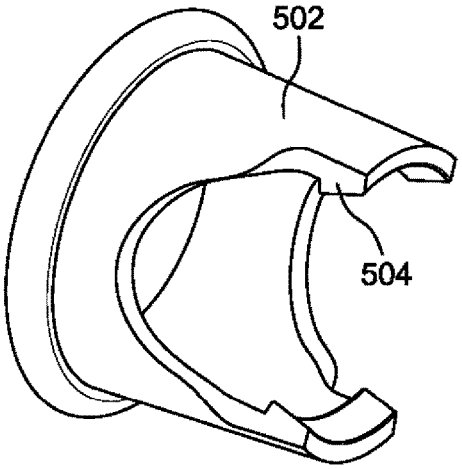
FIG. 6B is a perspective view of a top clip.

FIG. 6A shows a perspective view of an assembled holding device 100 formed by mateably engaging two halves of the holding device, i.e., a first longitudinal section (such as first longitudinal mateable half 300) and a corresponding second longitudinal section. Once mateably engaged, a top clip 502 and a bottom clip 506 may be slid over the external surface 400 of the initiator holder 102. The exemplary top clip 502 is shown in FIG. 6B. Each of the top clip 502 and the bottom clip 506 are provided with a protruding lip 504 to latch onto a radially extending wall 116 associated with the external surface 400 of the initiator holder 102. In the event that the top clip 502 and bottom clip 506 are unable to slide over the distal end of holder 102, instructions will be provided to the user to slide them over the initiator 104 and electrical cable 106 prior to mating the two halves 300. The top clip 504 will need to be slid up the initiator 104 and electrical cable 106 first, followed by the bottom clip 506. Once the halves 300 are mated, the bottom clip 506 and then the top clip 504 may be slid into latching engagement with the external surface 400 of the initiator holder 102.

Once in place, each of the top clip 502 and the bottom clip 506 retain the first longitudinal section and the second longitudinal section in engagement with one another by substantially preventing radial movement of the first longitudinal section and the second longitudinal section with respect to each other. The first engagement structures 300*a* and the second engagement structures 300*b* also act in concert with the top clip 502 and the bottom clip 506 to keep the first longitudinal section and the second longitudinal section in engagement. In the event that the top clip 502 and the bottom clip 506 are formed from a resilient material, the protruding lip 504 may be engaged and disengaged from the radially extending wall 116 to secure and remove the top clip 502 and the bottom clip 506.

The electrical cable 106 and the initiator 104 may be positioned respectively within the electrical cable receiving portion 202 and the initiator receiving section 104 before the first longitudinal section and the second longitudinal section are engaged, such that the electrical cable 106 and the initiator 104 are secured in their respective positions when the first longitudinal section and the second longitudinal section are engaged. Once the top clip 502 and the bottom clip 506 are in place, the electrical cable 106 is firmly gripped by the internal walls of the electrical cable receiving portion 202 of the longitudinal internal cavity 108 and, if present, the protrusions 202*a*. Further, the retention fingers 114 extending from the distal end of the initiator holder 102 retain the shaped charge 604 once the top clip 502 and the bottom clip 506 are in place. As discussed previously, the retention fingers 114 may be of a shape and material allowing for removal and placement of the shaped charge 604 subsequent to assembly of the holding device 100, including the top clip 502 and the bottom clip 506.

FIG. 1 illustrates an operational view of an exemplary, fully assembled holding device 600 for a detonation initiation system. The top clip 502 is positioned near the proximal end 101 of the initiator holder 102 and the bottom clip 506 is positioned near the distal end 103, adjacent the retention fingers 114. The electrical cable 106 is retained in the electrical cable receiving portion 202 as the top clip 502 and the bottom clip 506 urge the first longitudinal section and the second longitudinal section (as previously discussed) to firmly grasp the electrical cable 106, the initiator 104 and the shaped charge 604. A shaped charge holder 602 is depicted to be present near the distal end of the initiator holder 102. The shaped charge holder 602 may include the plurality of retention fingers 114 for retaining the shaped charge 604 therebetween. The initiator 104, as best seen in FIG. 2A, extends a short distance from the first end 110 of the initiator receiving section 120 such that the initiator 104 is as close as possible to a back wall portion (not shown) of the shaped charge 604. The initiator 104 is held in place by one or a combination of its attachment to the electrical cable 106 and frictional engagement by a wall of the initiator receiving section 120 of the initiator holder 102. In an embodiment, the shaped charge 604 may be encapsulated and hydraulically sealed. The electrical cable 106 may be connected to the initiator 104 and may be configured to convey an electrical activation or firing signal to begin an explosive process. The initiator 104 may be pressure-sealed and be operated wirelessly.

In various embodiments, the holding device 100 may be injection molded and composed of a thermoplastic material. The thermoplastic material may comprise at least one of a polyamide, polypropylene, polyethylene, polymethylene oxide, polytetrafluoroethylene, perfluoro(ethylene-propylene), nylon, polyethelene teraphthalate, polyvinylidene fluoride and combinations thereof. The primary factors in selecting a thermoplastic material are a melting point above 150° C., sufficient stiffness and low brittleness. Glass fiber additives may also be added to the liquid thermoplastic material prior to molding in order to improve the physical characteristics of the holding device 100, e.g., addition of 10% to 30% glass fiber additive to increase stiffness. The holding device 100 could also be made of any material suitable for use in high temperature mining applications. The detonation system holding device 100 can be used with an explosive emulsion in a borehole. Usage of the holding device 100 described in the above embodiments could result in improved explosive capacity of the detonation system in a borehole operation.

Advantages of using the holding device 100 includes and are not limited to the ones that are subsequently mentioned. Several components of the above described holding device 100 may typically be assembled, at least partly, on site by a user. The holding device 100 could be assembled and disassembled quickly, and the holding device 100 obtained upon assembling may be very sturdy. Structural integrity is provided to the holding device 100 with sliding collars, i.e. the top clip 502 and the bottom clip 506. These clips may be used at both ends of the initiator holder 102. Further, at the proximal end of the initiator holder 102, where the electrical cable 106 enters the longitudinal internal cavity 108, a portion of the electrical cable 106 is gripped by the walls of the electrical cable receiving portion 202 as well as optional protrusions 202*a* in the wall. The grip of the electrical cable 106, initiator 104 and shaped charge 604 may be greatly strengthened by the sliding collars, i.e., the top clip 502 and the bottom clip 506. The electrical cable 106 could thus be secured without usage of or resulting in knots, kinks, and loops. Such arrangement for securing the electrical cable 106 in the holding device 100 thus works as a strain relieving mechanism.

By using an encapsulated shaped charge and a pressure sealed initiator, sealing of the components in the field is avoided, and more explosive emulsion present in the borehole remains in direct contact with the shaped charge 604. This increases the initiation capability and reliability.

The present disclosure, in various embodiments, configurations and aspects, includes components, methods, processes, systems and/or apparatus substantially developed as depicted and described herein, including various embodiments, sub-combinations, and subsets thereof. Those of skill in the art will understand how to make and use the present disclosure after understanding the present disclosure. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A holding device for a detonation system, the holding device comprising:

an initiator holder having a first end, a second end opposite the first end, and a longitudinal internal cavity formed within the initiator holder and extending from the first end to the second end, wherein the internal cavity is configured for retaining an initiator and an electrical cable, the initiator holder including a first longitudinal half-section, a second longitudinal half-section, an external surface, and an internal wall that defines the internal cavity;

a top clip positioned on the external surface adjacent the second end of the initiator holder and configured for urging the first longitudinal half-section and the second longitudinal half-section radially inward, wherein the internal wall has a portion adjacent the top clip that frictionally retains the electrical cable; and a plurality of retention fingers extending from the first end of the initiator holder and configured for retaining a shaped charge within the holding device.

2. The holding device of claim 1, wherein the internal cavity further comprises:

a first section having a diameter configured for retaining the electrical cable; and an initiator receiving portion having a diameter configured for retaining the initiator.

3. The holding device of claim 2, wherein the diameter of the initiator receiving portion is greater than the diameter of the first section of the internal cavity.

4. The holding device of claim 2, wherein the diameter of the first section is between about 2 mm and about 8 mm, and the diameter of the initiator receiving portion is between about 5 mm and about 10 mm.

5. The holding device of claim 1, wherein the first longitudinal half-section is identical to the second longitudinal half-section.

6. The holding device of claim 1, wherein the top clip comprises a protruding lip configured to latch onto the external surface of the initiator holder.

7. The holding device of claim 1, wherein the shaped charge is aligned longitudinally with the initiator.

8. The holding device of claim 1, wherein each of the retention fingers is spaced apart from each other, thus allowing direct contact between an explosive emulsion in a borehole and the shaped charge.

9. The holding device of claim 1, wherein the holding device is injection molded.

10. The holding device of claim 9, wherein the holding device is composed of a thermoplastic material.

11. The holding device of claim 10, wherein the thermoplastic material is selected from the group consisting of polyamide, polypropylene, polyethylene, polymethylene oxide, polytetrafluoroethylene, perfluoro(ethylene-propylene), nylon, polyethylene terephthalate, polyvinylidene fluoride and combinations thereof.

12. A holding device for a detonation system, the holding device comprising:

an initiator holder configured to receive an initiator and having a first end, a second end opposite the first end, a longitudinal internal cavity formed within the initiator holder and extending from the first end to the second end, a first longitudinal section, a second longitudinal section, an external surface, and an internal wall that defines the internal cavity;

a top clip positioned on the external surface adjacent the second end of the initiator holder and configured for urging the first longitudinal section and the second longitudinal section radially inward, wherein the internal wall has a portion adjacent the top clip that frictionally retains an electrical cable; and a shaped charge holder configured to receive a shaped charge, wherein the shaped charge holder extends from the initiator holder and is aligned with the initiator holder such that the initiator is longitudinally aligned with a back wall portion of the shaped charge, and the shaped charge holder comprises a plurality of fingers configured to retain the shaped charge therebetween.

13. The holding device of claim 12, further comprising:

a first section of the initiator holder configured for retaining the electrical cable; and an initiator receiving portion of the initiator holder configured for retaining the initiator.

14. The holding device of claim 12, further comprising a bottom clip positioned at the first end of the initiator holder.

15. The holding device of claim 12, wherein the holding device is configured for use with an explosive emulsion in a borehole.

16. A method of detonating an explosive emulsion in a borehole, the method comprising:

lowering a holding device housing an initiator and a shaped charge into a borehole containing an explosive emulsion;

activating the initiator;

initiating the shaped charge in response to activating the initiator; and detonating the explosive emulsion in response to initiating the shaped charge, wherein the holding device includes:

an initiator holder configured to receive the initiator, the initiator being connected to an electrical cable that extends from the holding device, the initiator holder having a first end, a second end opposite the first end, a longitudinal internal cavity formed within the initiator holder and extending from the first end to the second end, a first longitudinal section, a second longitudinal section, an external surface, and an internal wall that defines the internal cavity;

a top clip positioned on the external surface adjacent the second end of the initiator holder and configured for urging the first longitudinal section and the second longitudinal section radially inward, wherein the internal wall has a portion adjacent the top clip that frictionally retains the electrical cable; and a shaped charge holder connected to the initiator holder, the shaped charge holder having a plurality of retention fingers extending from the initiator holder and configured for retaining the shaped charge within the holding device.

17. The method of detonating an explosive emulsion in a borehole of claim 16, wherein activating the initiator includes sending an electrical signal through the electrical cable to cause activation of the initiator.

* * * * *